US008419879B2

(12) United States Patent
Rickli

(10) Patent No.: US 8,419,879 B2
(45) Date of Patent: Apr. 16, 2013

(54) METHOD AND APPARATUS FOR COMBINING TWO FLAT PRODUCTS WITH ADHESIVE

(75) Inventor: Ulrich Rickli, Riken (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/605,649

(22) Filed: Oct. 26, 2009

(65) Prior Publication Data

US 2010/0101712 A1 Apr. 29, 2010

(30) Foreign Application Priority Data

Oct. 24, 2008 (EP) ..... 08405267

(51) Int. Cl.
*B44C 3/02* (2006.01)

(52) U.S. Cl.
USPC ..... 156/230; 156/566; 198/586; 198/575; 198/601

(58) Field of Classification Search ..... 156/556, 156/230, 566; 198/586, 575, 601
See application file for complete search history.

(56) References Cited

U.S. PATENT DOCUMENTS 5,425,837 A * 6/1995 Hansch ..... 156/536
6,550,517 B1 * 4/2003 Hilt et al. ..... 156/557

FOREIGN PATENT DOCUMENTS

EP 0 606 550 7/1994
EP 1 112 861 7/2001

OTHER PUBLICATIONS

European Search Report issued in Priority Application No. 08405267.9.

* cited by examiner

*Primary Examiner* — Khanh P Nguyen
*Assistant Examiner* — Vishal I Patel
(74) *Attorney, Agent, or Firm* — Venable LLP; Robert Kinberg

(57) ABSTRACT

A method for combining with adhesive at least two flat products positioned at least partially one above the other is provided. The method includes moving first flat products in an overlapping flow along a guiding line in a conveying direction and separating the first flat products into a non-overlapping flow after leaving the guiding line and while being conveyed through an underneath-arranged conveying region. The method also includes supplying second flat products from underneath the first flat products with a synchronous time relative to the first flat products. The second flat products each have an adhesive surface. The method further includes combining a respective one of the first flat products along the adhesive covered surface of an underneath supplied respective one of the second flat products.

6 Claims, 2 Drawing Sheets

METHOD AND APPARATUS FOR COMBINING TWO FLAT PRODUCTS WITH ADHESIVE

CROSS-REFERENCE TO RELATED APPLICATION

This application claims the priority of European Patent Application No. 08405267.9, filed on Oct. 24, 2008, the subject matter of which is incorporated herein by reference.

FIELD

The subject matter of the application relates to a method for combining at least two flat products with adhesive, especially for combining printed products, positioned at least partially one above the other, with an additionally supplied product, a sample, a card, a supplement, a label or the like.

The European patent document EP 1 112 861 A1 discloses a method, for which flat or flexible supplemental products are provided with adhesive and combined with printed products to form print matter. In the process, supplemental products held in place by holding elements are picked up along a circular path and are transferred to printed products that are conveyed while suspended in a conveying flow.

The short gap or spacing between the clamps of a conveying device or a transporter, which leaves little clearance space for attaching the supplemental products is somewhat problematic during the transfer or the combining of the printed products or the like.

SUMMARY

Embodiments of the present application provide for a method and apparatus of the aforementioned type, which allows combining at least two flat products, with the aid of adhesive, in a reliable and precise manner, as well as with a simple device.

The above and other objects are accomplished according to one aspect of the invention wherein there is provided a method for combining with adhesive at least two flat products positioned at least partially one above the other, comprising: moving first flat products in an overlapping flow along a guiding line in a conveying direction; separating the first flat products into a non-overlapping flow after leaving the guiding line and while being conveyed through an underneath-arranged conveying region; supplying second flat products from underneath the first flat products with a synchronous time relative to the first flat products, the second flat products each having an adhesive surface; combining a respective one of the first flat products along the adhesive covered surface of an underneath supplied respective one of the second flat products.

In another embodiment, there is provided an apparatus for combining with adhesive at least first and second flat products positioned at least partially one above the other, comprising: a conveying device to convey first flat products in a conveyed flow in a conveying direction, the conveying device including a conveying section and a plurality of uniformly space-apart clamps to transport the first flat products along the conveying section; a guide arrangement including a guide device extending approximately parallel to the conveying direction to assist in conveying the flow of first flat products along the conveying section; a curved, underneath-arranged conveying region that operatively follows the guide arrangement in the conveying direction; a feed device disposed below the underneath-arranged conveying region to feed the second flat products having an adhesive on a surface facing an underside of the first flat products, the feed device extending tangential to the underneath-arranged conveying region so that the underneath-arranged conveying region empties into the feed device for combining together respective ones of the first flat products with respective ones of the second flat products.

In one embodiment, the first products, which may be dragged or pushed in an overlapping formation in a conveyed flow along a guiding line, may be separated to form a non-overlapping flow of first products. Once the first products leave the guiding line and during the subsequent passage through an underneath-arranged conveying region, the first products may be joined with a second product. The second product may be supplied with synchronized timing below the first product and combined with the first product along a surface of the second product that is provided with adhesive and faces the first product.

Prior to reaching the guiding line, the products may be redirected counter to the conveying direction and trailing. The trailing suspended products may be pulled across an obstacle to change the position of these products to the opposite direction to enable the products to glide along the guide device.

If the products are moved by pushing them along the guide device, they may be supplied from a suspended position, for example, via an approximately perpendicular, funnel-shaped section of the conveying device to the guide device and may be transported to glide along this device.

The optional device which may be used for dragging or pushing first products may thus be easily adjusted or replaced at the conveying channel intake, which may narrow down continuously in a conveying direction F.

For separating the products in the overlapping flow to form a non-overlapping flow of successively following products, the printed products may move through a curved, underneath-arranged (undershot) conveying region that follows the guiding line, such that the products may easily leave the overlapping formation.

The second products may be supplied successively spaced apart and approximately tangential to the curved underneath-arranged conveying region, thus making it possible to achieve a precise joining with a continuous feeding.

The guiding line along which the first products may be dragged or pushed in an overlapping flow may extends approximately parallel to the conveying direction for the supplied products, thus resulting in a calming of the conveyed flow and clearly defined spacing between the products in the overlapping flow. The first products conveyed while pushed along may be redirected before reaching the guiding line to a position in which they may be oriented to be leading in conveying direction.

Starting from the curved, underneath-arranged conveying region and the conveying device that may be redirected approximately parallel thereto, the overlapping flow of first products may be separated, so that a lower surface of the products may be exposed to which the second product may be attached. The second products in each case may be distributed and placed onto the exposed surfaces of the first products which face the second products.

An apparatus for combining with the aid of adhesive two flat products that may be positioned at least partially and horizontally one above the other, in particular for combining a printed product with a supplied second printed product, a sample, a card, a supplement or the like. The apparatus may also include transport clamps that may be attached uniformly spaced apart to a conveying device for transporting first products and may be provided along a conveying section of the conveying device with an approximately parallel extending guide device of a guide arrangement for forming a conveyed flow of redirected first products.

The downstream end of this guide arrangement may form a curved, underneath-arranged conveying region that follows the conveying section. The downstream end may empty into a feed device that extends tangential to the conveying region. The feed device may feed second products, provided with adhesive on a surface that is facing the underside of the first product, to combine with the first product. As a result of combining the two products, the second product may be considered as supplied to the first product or the first product may be considered as supplied to the second product.

The guide device for forming a conveyed flow of first products may be adjustable such that it may be locked in position for changing the cross-section of the conveyed flow. The change provides for the processing of different formats of the first product.

The guide arrangement may be provided, at least in the end region for guidance, with a guide section. The guide section may reverse the conveyed flow which may separate or move apart the first products transported in an overlapping flow from each other. The conveying device may be guided around a reversing or guide wheel which may achieve the redirecting of the conveyed flow.

The format of the first products may be varied. Accordingly, the distance between the feed device for the second products and the conveying device for the first products may be changed in an outlet area. As a result, the exposed surface of the first product that faces a second product may selectively be used for gluing on the second product, which could also project on the side over the first product. An adhesive applicator may be provided along the feed device for applying adhesive to the second products while the surfaces of these products are moving past the adhesive applicator.

A drive motor for the conveying device for the first products and a drive motor for the feeding device for the second products may also be provided, together with a connected control unit. The control unit may function to change or synchronize the speed between the conveying device and the feed device, such that the timing sequence may be maintained or changed or the position of the second product on the first product may be determined.

BRIEF DESCRIPTION OF THE DRAWINGS

The present application will be more readily understood from the following detailed description when read in conjunction with the accompanying drawings, in which.

DETAILED DESCRIPTION

Figure 1:
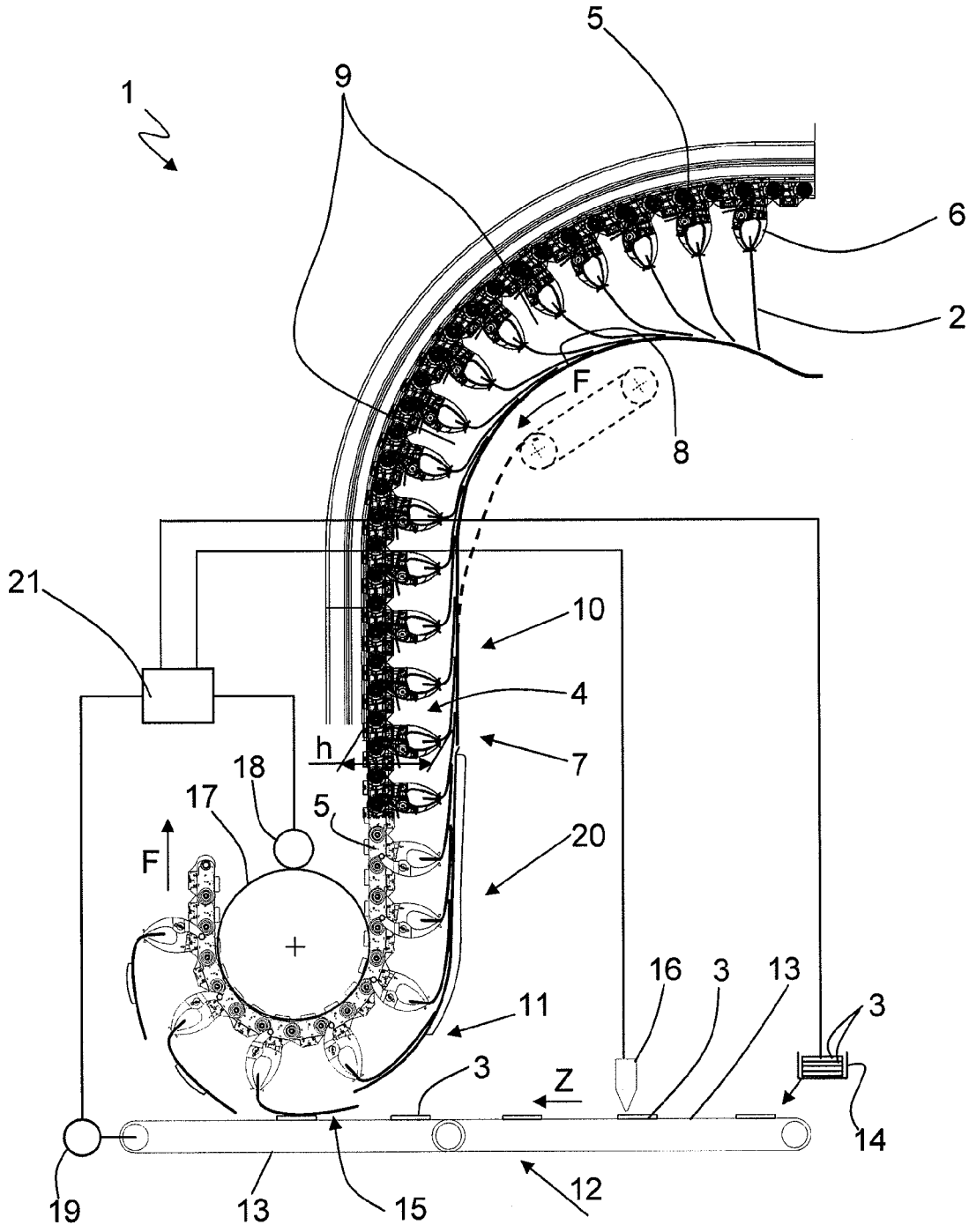
FIG. 1 is a view from the side of one embodiment of the apparatus.

FIG. 1 shows an apparatus 1 for combining together two flat products 2, 3, positioned at least in part one above the other. The products 2, 3, may be combined with adhesive. Each product may be, but not limited to, another printed product, a sample, a card, a supplement, a label or the like. The apparatus 1 may include a conveying device 4 provided with clamps 6. The clamps may be attached uniformly spaced apart to a circulating traction device 5, e.g. a chain or a belt. The clamps 6 may hold in place or clamp in the first products 2 along an edge region. The conveying device 4 may also be referred to as a transporter. The first products 2 may be gripped by the exposed ends to be suspended above a guide element 8 that is arranged upstream of a guide device 7, as seen in a conveying direction. The guide element may then redirect the opposite end of the first product 2 counter to the conveying direction F or toward the back.

As a result of the relatively short distance between two clamps, for example 4 inches or 6 inches, an overlapping conveying flow 9 may be generated at least along the guide device 7 in which the respectively trailing first product 2 partially covers a leading first product 2. The first products 2 are thus dragged along a guiding line while partially overlapped. The guiding line may form a conveying channel 10 that extends downward in an approximately vertical direction. As a result of the guiding line extending parallel to the conveying device 4, the conveying channel 9 may have a uniform height in the region of the guide device 7.

A curved, underneath-arranged conveying region 11 follows the conveying channel 9 at the end of the guide device 7 and forms a guide arrangement together with the guide device 7. The guide arrangement may end in front of a feed device 12 for the second products 3, which extends tangential to the curved, underneath-arranged conveying region 11. The feed device 12 for the second products 3 may include conveying belts 13 that circulate in feed direction Z and take over the second products 3 from a bin 14. The feed device 12 guides these products with uniform spacing into the outlet region 15 of the first products 2 at the end of the guide arrangement. The feeding of the second products 3 or the first products 2 at the outlet region 15 is timed.

An adhesive applicator 16 applies adhesive to the exposed surface of the second products 3. The applicator 16 is arranged along the approximately horizontal feed path for the second products 3. In the outlet region 15, the first products 2 separately leave the guide arrangement and come to rest on the second products 3, wherein a first product 2 is then joined to a second product because of the applied adhesive. The first products 2 and second products 3 may be conveyed further together while the first product 2 is held in a clamp 6 of the conveying device 4.

The first product 2 may be placed onto the second product 3 by gravity or the pre-tensioning forces generated by reversing the course of the first product. The curved, underneath-arranged conveying region 11 may be created with the aid of a guide wheel 17 on the conveying device 4, with a guide arrangement 20, and/or with the feed device 12 in the outlet region 15. The guide arrangement 20 may be provided with a reversing section, formed by the conveying device 4, for reversing the conveyed flow 9 in the end region of the guidance.

The distance between the approximately tangential feed device 12 for the second products 3 and the conveying device 4 for the first products 2 may be changeable in the outlet region, such that an optimum adjustment may be possible and the first products 2 may impact precisely with the second products 3 at the predetermined location. A drive motor 18 for the conveying device in connection with the guide wheel 17 and a drive motor 19 for the feed device 12 are connected to a control unit 21 for changing or synchronizing the speeds of the conveying device 4 and the feed device 12. A feeder for feeding the second products 3 and the adhesive applicator 16 may also be connected via lines to the control unit 21, to ensure a clocked processing as proposed. The drive motors 18, 19 may be embodied for this purpose such that they may be controlled or regulated. For example, the motors 18, 19 may be torque-controlled motors.

Figure 2:
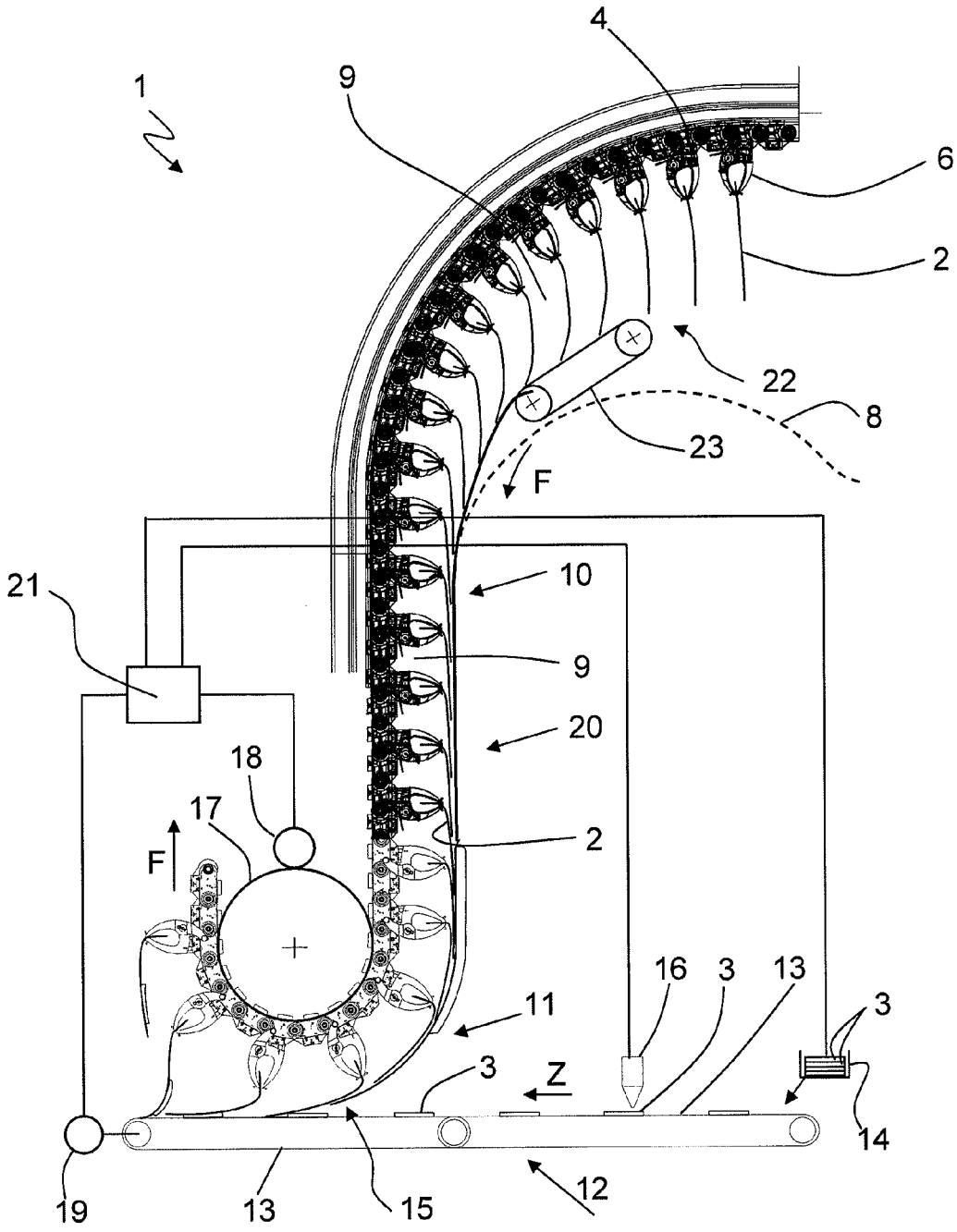
FIG. 2 is a view from the side of another embodiment of the apparatus.

The embodiment shown in FIG. 2 differs from the embodiment according to FIG. 1 by the manner in which the first products 2 are moved through the conveying channel 10, formed by the conveying device 4 and the guide device 7. In FIG. 1, following the horizontal repositioning, the first products 2 are conveyed in conveying direction F while pulled or dragged in an overlapping arrangement along the adjustable guide device 7. In FIG. 2, the guide element 8 that is shown in FIG. 1 may be pivoted away or removed for this embodiment. In FIG. 2, the first products 2, held inside the clamps 6 of the conveying device 4, are taken in with the aid of an acceleration device 22 that grips the print products 2 along the outside ends.

The acceleration device 22 may include a circulating belt 23 which ensures that the first products 2 are accelerated in the conveying direction F along the outside ends, so that the print products 2 reach the conveying channel 10 with the outside ends leading and are pushed to form an overlapping flow along the guide device 7 or the guiding line. The trailing first product in this case may be positioned underneath the leading first product 2 and the outside end of the first products leaves the guide arrangement 20 in the underneath-arranged conveying region 11 or in the outlet region 15 before the end of the first product 2 that is clamped into the clamp 6.

The proposed method steps and apparatus make it possible to attach a supplied second product 3 to one flat side of the first product 2 or, with a second passage, to attach a second product to both flat sides by changing the conveying channel intake area.

With the embodiment according to FIG. 1, as well as with the embodiment according to FIG. 2, the first products 2 may be transported via clamps 6 along a folded edge or an open edge. It will be understood that the above description of the present invention is susceptible to various modifications, changes and adaptations, and the same are intended to be comprehended within the meaning and range of equivalents of the appended claims.

What is claimed is:

1. A method for combining with adhesive at least two flat products positioned at least partially one above the other, comprising:

moving first flat products in an overlapping flow along a guiding line in a conveying direction;

prior to reaching the guiding line, selectively directing an exposed free end of the first flat products one of (a) counter to the conveying direction, wherein the moving includes subsequently dragging the first flat products along the guiding line, and (b) in the conveying direction, wherein the moving includes subsequently pushing the first flat products along the guiding line;

separating the first flat products into a non-overlapping flow after leaving the guiding line and while being conveyed through a curved, underneath-arranged conveying region;

supplying second flat products in a direction approximately tangential to the curved, underneath-arranged conveying region and from underneath the first flat products with a synchronous time relative to the first flat products, the second flat products each having an adhesive coated surface; and attaching one surface of a respective one of the first flat products along the adhesive covered surface of an underneath supplied respective one of the second flat products if the first flat products are dragged along the guiding line and attaching a surface opposite the one surface of a respective one of the first flat products along the adhesive covered surface of an underneath supplied respective one of the second flat products if the first flat products are pushed along the guiding line.

2. The method according to claim 1, wherein the separating includes passing the first flat products through the curved underneath-arranged conveying region in the flow of successively following non-overlapping first flat products.

3. The method according to claim 2, wherein the supplying includes supplying the second flat products successively spaced apart.

4. The method according to claim 1, wherein the moving includes moving the first flat products along the guiding line which runs approximately parallel to the conveying direction of the first flat products.

5. The method according to claim 1, wherein the supplying the second flat products includes spacing apart the second flat products on behind the other.

6. The method of claim 1, further comprising arranging a respective one of the second flat products on an exposed surface of a respective one of the first flat products.

* * * * *